US010319339B2

(12) United States Patent
Mo et al.

(10) Patent No.: US 10,319,339 B2
(45) Date of Patent: Jun. 11, 2019

(54) DATA TRANSMISSION METHOD, PROCESSOR AND TERMINAL

(71) Applicant: FOCALTECH SYSTEMS, LTD., George Town, Grand Cayman (KY)

(72) Inventors: Lianghua Mo, Guangdong (CN); Xinxi Jiang, Guangdong (CN); Chien kuo Wang, Guangdong (CN)

(73) Assignee: FOCALTECH SYSTEMS, LTD., Grand Cayman (KY)

( * ) Notice: Subject to any disclaimer, the term of this patent is extended or adjusted under 35 U.S.C. 154(b) by 251 days.

(21) Appl. No.: 15/039,417

(22) PCT Filed: Feb. 19, 2014

(86) PCT No.: PCT/CN2014/072250
§ 371 (c)(1),
(2) Date: May 26, 2016

(87) PCT Pub. No.: WO2015/078111
PCT Pub. Date: Jun. 4, 2015

(65) Prior Publication Data

US 2017/0039992 A1 Feb. 9, 2017

(30) Foreign Application Priority Data

Nov. 26, 2013 (CN) ..... 2013 1 0611509

(51) Int. Cl.
*G09G 5/04* (2006.01)
*G09G 5/00* (2006.01)
(Continued)

(52) U.S. Cl.
CPC ..... *G09G 5/04* (2013.01); *G09G 3/2003* (2013.01); *G09G 5/006* (2013.01);
(Continued)

(58) Field of Classification Search
CPC combination set(s) only.
See application file for complete search history.

(56) References Cited

U.S. PATENT DOCUMENTS

2007/0257946 A1* 11/2007 Miller ..... G09G 3/2003 345/694
2008/0204480 A1 8/2008 Van Mourik
(Continued)

FOREIGN PATENT DOCUMENTS

CN 1864198 A 11/2006
CN 101107645 A 1/2008
(Continued)

OTHER PUBLICATIONS

Second Korean Office Action for corresponding Application No. 10-2016-7016348 dated Dec. 12, 2017.
(Continued)

*Primary Examiner* — Wesner Sajous
(74) *Attorney, Agent, or Firm* — Yue (Robert) Xu; Apex Attorneys at Law, LLP

(57) ABSTRACT

A data transmission method, a processor and a terminal. The method in the embodiments of the present invention comprises: converting, by a processor, RGB data into Pentile data; sending, by the processor, the Pentile data which is obtained after conversion to a display drive system, so that the display drive system sends a drive signal, into with the Pentile data is converted, to a display system. Therefore, there is no need to use an additional chip, thereby saving the costs of hardware, and reducing the power consumption and electric power consumption of transmission.

3 Claims, 6 Drawing Sheets

(51) Int. Cl.

| | |
|---|---|
| ***H04N 1/60*** | (2006.01) |
| ***H04N 5/57*** | (2006.01) |
| ***H04N 9/64*** | (2006.01) |
| ***H04N 9/73*** | (2006.01) |
| ***G09G 3/20*** | (2006.01) |

(52) U.S. Cl.
CPC ..... *G09G 2300/0452* (2013.01); *G09G 2320/0666* (2013.01); *G09G 2330/021* (2013.01); *G09G 2340/06* (2013.01); *G09G 2370/00* (2013.01)

(56) References Cited

U.S. PATENT DOCUMENTS

| | | | | |
|---|---|---|---|---|
| 2009/0021534 | A1 | 1/2009 | Tomizawa et al. | |
| 2010/0259556 | A1* | 10/2010 | Inuzuka | G09G 3/3611 345/604 |
| 2011/0043533 | A1* | 2/2011 | Han | G09G 5/02 345/589 |
| 2011/0109658 | A1 | 5/2011 | Park | |
| 2011/0238906 | A1 | 9/2011 | Amir | |
| 2012/0306947 | A1 | 12/2012 | Kim | |
| 2013/0021227 | A1* | 1/2013 | Saigo | G09G 5/02 345/55 |
| 2013/0033517 | A1 | 2/2013 | Choi | |
| 2013/0050165 | A1* | 2/2013 | Northway | G09G 3/3466 345/207 |
| 2013/0271356 | A1 | 10/2013 | Yoshida et al. | |
| 2014/0210878 | A1 | 7/2014 | Broughton et al. | |
| 2015/0144893 | A1 | 5/2015 | Chen | |
| 2015/0154762 | A1 | 6/2015 | Yang | |
| 2016/0027382 | A1* | 1/2016 | Chaji | G09G 3/006 345/212 |

FOREIGN PATENT DOCUMENTS

| | | | |
|---|---|---|---|
| CN | 101860762 | A | 10/2010 |
| CN | 102779495 | A | 11/2012 |
| CN | 102810293 | A | 12/2012 |
| CN | 102915721 | A | 2/2013 |
| CN | 103218988 | A | 7/2013 |
| CN | 103280162 | A | 9/2013 |
| EP | 2639785 | A2 | 9/2013 |
| JP | 2008529051 | A | 7/2008 |
| JP | 2008546006 | A | 12/2008 |
| JP | 2011186201 | A | 9/2011 |
| KR | 20080011659 | A | 2/2008 |
| KR | 20110052108 | A | 5/2011 |
| TW | 201331922 | A | 8/2013 |
| WO | WO2004021323 | A2 | 3/2004 |
| WO | 2006115165 | A1 | 11/2006 |
| WO | 2006127555 | A2 | 11/2006 |
| WO | 2012/090880 | A1 | 7/2012 |

OTHER PUBLICATIONS

Report on Reconsideration by Examiner before Appeal dated Aug. 2, 2018 for Japanese patent application No. 2016-534245, 3 pages, English translation provided by Global Dossier.
The Japanese First Office Action for JP 2016-534245, dated May 12, 2017.
International Search Report.
The Chinese Second Office Action for CN 201310611509.5, dated Sep. 18, 2016.
Ichikawa jiro, "The organic El of the 106th Dream of the Happiness Theater of Ichikawa Erlang is coming soon!! ~ From the main display to the lighting. The spring organic EL event~", AV Review Feb. 2012, Ltd. Phonetic Publishing, Japan, Feb. 25, 2012, vol. 29, No. 2, vol. 206, p. 100-105, ISSN0289-6044 (Documents used to confirm the meaning of "(RGB)Pentile").
News Flash "Clairvoyante and Korea's Tomato LSI license agreement for VGA driver IC manufacturing", monthly publication Jun. 2007 issue, technotimes, Japan, Jun. 1, 2007, vol. 13 No. 6 (vol. 145), p .68, ISSN 1341-3961 (a document used to confirm the meaning of "(primary color) Pentile").
Japanese Fourth Office Action dated Mar. 5, 2019.

* cited by examiner

DATA TRANSMISSION METHOD, PROCESSOR AND TERMINAL

CROSS REFERENCE OF RELATED APPLICATION

The present application is the national phase of International Application No. PCT/CN2014/072250, titled "DATA TRANSMISSION METHOD, PROCESSOR AND TERMINAL", filed on Feb. 19, 2014, which claims priority to Chinese Patent Application No. 201310611509.5, titled "DATA TRANSMISSION METHOD, PROCESSOR AND TERMINAL", filed on Nov. 26, 2013 with the State Intellectual Property Office of People's Republic of China, both of which are incorporated herein by reference in entireties.

FIELD

The present disclosure relates to the technical field of communications, and in particular to a data transmission method, a processor and a terminal device.

BACKGROUND

A pixel arrangement of Pentile refers to an arrangement manner, mainly including an arrangement of Red, Green, Blue and White (RGBW), an arrangement of Red, Green, Blue and Yellow (RGBY), and the like. Pentile has been applied to current display devices. Pentile of four primary colors are achieved by adding a sub-pixel of a color on the basis of tricolor. Arrangements of different four primary colors have different advantages over the arrangements of tricolor. For example, the arrangement of RGBW may improve the utilization of backlight by a liquid crystal display (LCD) to increase the display brightness of the LCD and reduce the power consumption of the LCD, and the arrangement of RGBY may increase the color gamut of the LCD.

In the conventional technology, an additional chip is added in a terminal device to transmit Pentile data to a display system of the terminal device, not only increasing the costs of hardware but also increasing the power consumption for transmission.

SUMMARY

A data transmission method, a processor and a terminal device are provided according to embodiments of the present disclosure, which can save the costs of hardware and reduce the power consumption for transmission.

A data transmission method is provided according to an embodiment of the present disclosure, which includes: converting, by a processor, RGB data into Pentile data; and sending, by the processor, the Pentile data obtained after conversion to a display drive system, where the display drive system sends a drive signal, which is generated by converting the Pentile data, to a display system. The processor, the display drive system and the display system are configured in a same terminal device.

A processor is provided according to an embodiment of the present disclosure, which includes a converting unit and a sending unit.

The converting unit is configured to convert RGB data into Pentile data. The sending unit is configured to send the Pentile data obtained after conversion to a display drive system, and the display drive system sends a drive signal, which is generated by converting the Pentile data, to a display system. The processor, the display drive system and the display system are configured in a same terminal device.

A terminal device is provided according to an embodiment according to the present disclosure, which includes a processor, a display drive system and a display system.

The processor is configured to convert RGB data into Pentile data and send the Pentile data obtained after conversion to the display drive system. The display drive system is configured to send a drive signal, which is generated by converting the Pentile data, to the display system. The display system is configured to display an image based on the received drive signal.

As can be seen from the above technical solutions, the embodiments of the present disclosure have the following advantages.

In the embodiments, the processor converts the RGB data into the Pentile data and sends the Pentile data obtained after conversion to the display drive system, and the display drive system sends the drive signal, which is generated by converting the Pentile data, to the display system. In this way, only the original processor of the terminal device is used without an additional chip, thereby saving the costs of hardware and reducing the power consumption for transmission.

BRIEF DESCRIPTION OF THE DRAWINGS

The accompanying drawings needed to be used in the description of embodiments are described briefly as follows, so that the technical solutions according to the embodiments of the present disclosure become clearer. It is apparent that the accompanying drawings in the following description are only some embodiments of the present disclosure. For those skilled in the art, other accompanying drawings may be obtained based on these accompanying drawings without any creative work.

DETAILED DESCRIPTION OF EMBODIMENTS

According to embodiments of the present disclosure, there are provided a data transmission method, a processor and a terminal device, which can save the costs of hardware and reduce power consumption for transmission.

Figure 1:
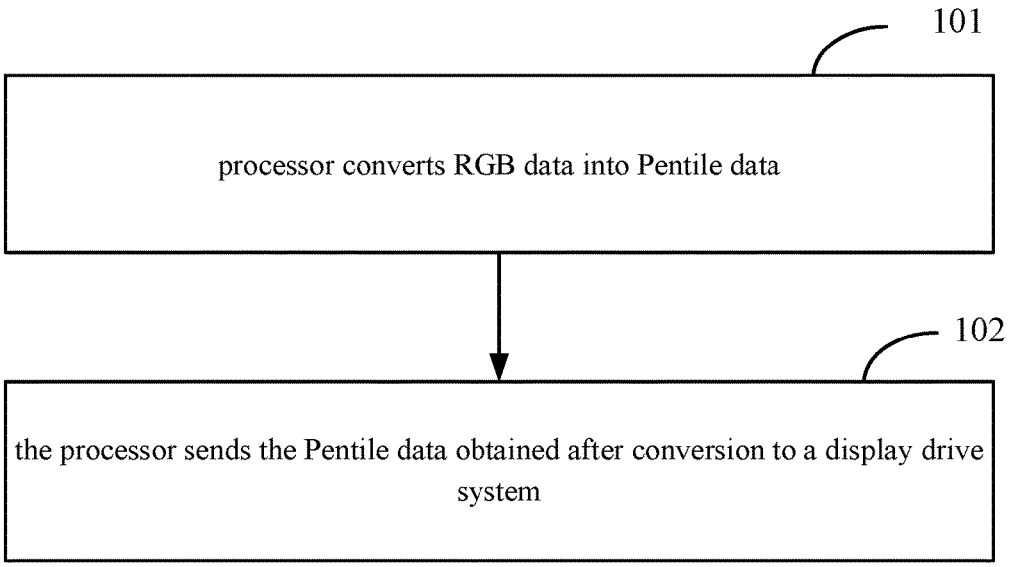
FIG. 1 is a schematic diagram of a data transmission method according to an embodiment of the present disclosure.

Referring to FIG. 1, a data transmission method according to an embodiment of the present disclosure includes step 101 and step 102.

In step 101, RGB data are converted by a processor into Pentile data.

In the embodiment, the processor is capable of converting the RGB data into the Pentile data. In practice, the Pentile data include data of various pixel arrangements, such as Pentile RGB, Pentile RGW, Pentile RGBY.

In step 102, the Pentile data obtained after conversion are sent by the processor to a display drive system, and the display drive system sends a drive signal, which is generated by converting the Pentile data, to a display system.

In the embodiment, the processor sends the Pentile data obtained after conversion to the display drive system, and the display drive system sends the drive signal, which is generated by converting the Pentile data, to the display system. The processor, the display drive system and the display system are configured in a same terminal device. In practice, the terminal device may include a handheld device, a television, a computer and the like.

It should be noted that the processor is a central processing unit (CPU) owned originally by the terminal device.

In the embodiment, the processor converts the RGB data into the Pentile data and sends the Pentile data obtained after conversion to the display drive system, and the display drive system sends the drive signal, which is generated by converting the Pentile data, to the display system. Thus, only the original processor of the terminal device is used for conversion without an additional chip, thereby saving the costs of hardware and reducing the power consumption for transmission.

Figure 2:
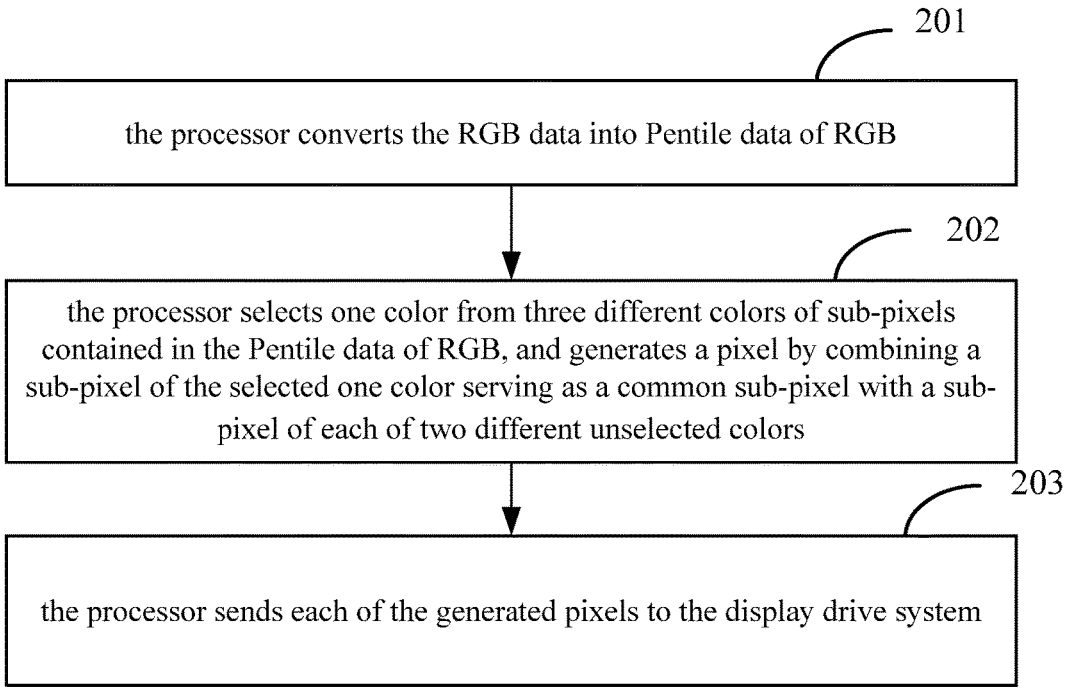
FIG. 2 is a schematic diagram of a data transmission method according to an embodiment of the present disclosure.

For better understanding, the data transmission method according to the embodiment of the present disclosure is described with a specific example. Referring to FIG. 2, in a case that the Pentile data are Pentile data of RGB, a data transmission method according to an embodiment of the present disclosure includes step 201 to step 203.

In step 201, the RGB data are converted by the processor into Pentile data of RGB.

In the embodiment, the processor is capable of converting standard RGB data into Pentile data of RGB. An approach for the conversion may be found in the conventional technology, which is described herein.

In step 202, one color is selected by the processor from three different colors of sub-pixels contained in the Pentile data of RGB; and a pixel is generated by the processor by combining a sub-pixel of the selected one color serving as a common sub-pixel with a sub-pixel of each of two different unselected colors.

In the embodiment, the processor is capable of selecting one color from three different colors of sub-pixels contained in the Pentile data of RGB, and generating a pixel by combining a sub-pixel of the selected one color serving as a common sub-pixel with a sub-pixel of each of two different unselected colors. Multiple such pixels are generated from the Pentile data of RGB. In practice, the color for the common sub-pixel is selected randomly.

Figure 3:
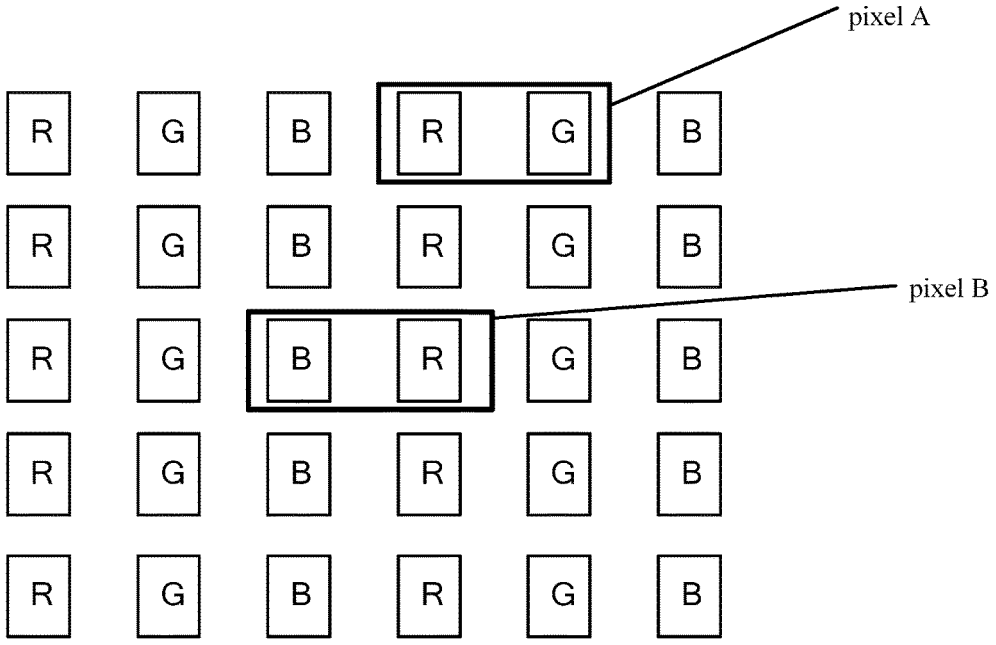
FIG. 3 is a schematic diagram of an arrangement of RGB Pentile according to an embodiment of the present disclosure.

Reference is made to FIG. 3, which is a schematic diagram of an arrangement of RGB Pentile. In FIG. 3, each rectangle block represents a sub-pixel, and text in the rectangle block indicates a color of the sub-pixel. For example, if red color is selected as a color for a common pixel, a pixel (such as a pixel A shown in FIG. 3) is generated by combining a sub-pixel of red color with a sub-pixel of green color, and a pixel (such as a pixel B shown in FIG. 3) is generated by combining the sub-pixel of red color with a sub-pixel of blue color. In this way, the Pentile data of RGB is converted to data of pixels each consisting of a sub-pixel of red color and a sub-pixel of green color and pixels each consisting of a sub-pixel of red color and a sub-pixel of blue color.

In step 203, each of the generated pixels is sent by the processor to the display drive system.

In the embodiment, the processor sends each of the generated pixels to the display drive system, and the display drive system sends a drive signal, which is generated by converting the Pentile data, to the display system.

The transmission rate for the processor to send the Pentile data of RGB to the display drive system is described by taking a mobile phone as an example hereinafter.

Assuming that the mobile phone is to display a high definition (HD) image of 720P transmitted through double channels of mobile industry processor interface (MIPI), the amount of data to be transmitted equals to 1280*720*2*8. If a frame rate is of 60, the transmission rate for the MIPI is of only 550 MHz. However, in the conversional technology, a processor has to transmit RGB data to an additional chip, and thus the amount of data of the same image to be transmitted with the same MIPI equals to 1280*720*3*8. If a frame rate is still of 60, the transmission rate for the MIPI is of 850 MHz. And then the Pentile data are transmitted from the additional chip to the display drive system. It can be seen from the comparison that the bandwidth for data transmission and the power consumption for transmission are reduced with the innovation.

In the embodiment, the processor converts the RGB data into the Pentile data of RGB, then selects one color from three different colors of sub-pixels contained in the Pentile data of RGB, generates a pixel by combining a sub-pixel of the selected one color serving as a common sub-pixel with a sub-pixel of each of two different unselected colors, and sends each of the generated pixels to the display drive system, and the display drive system sends the drive signal, which is generated by converting the Pentile data, to the display system. In this way, only two sub-pixels are transmitted to the display drive system at a time by the original processor of the terminal device, thereby not only saving the costs of hardware but also reducing the power consumption for transmission.

Figure 4:
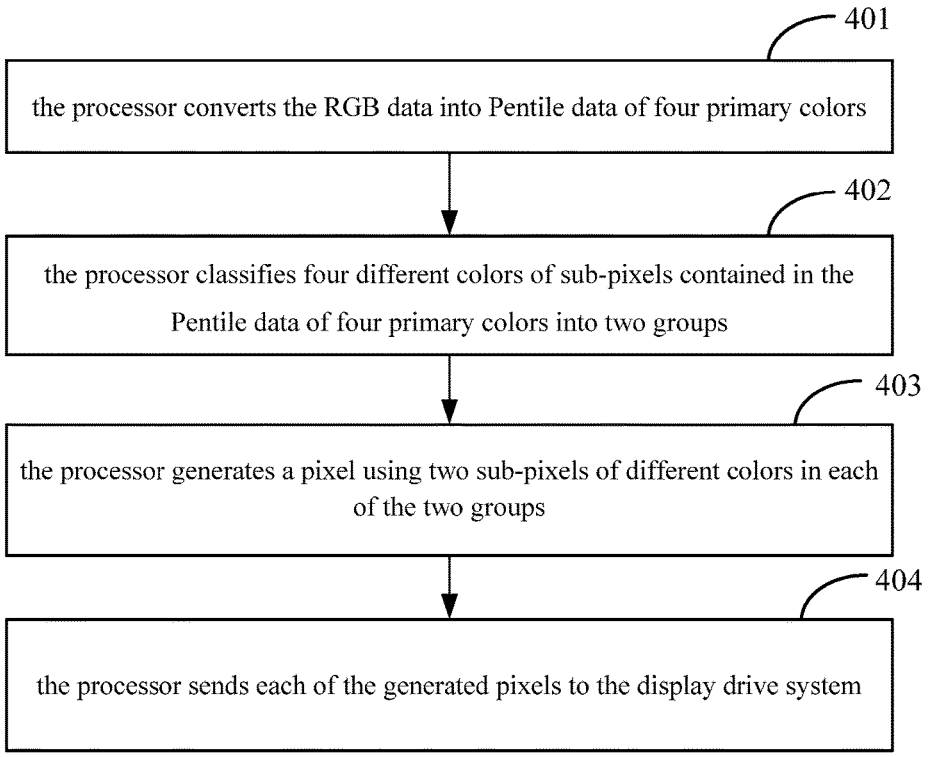
FIG. 4 is a schematic diagram of a data transmission method according to an embodiment of the present disclosure.

For better understanding, the data transmission method according to the embodiment of the present disclosure is described with a specific example. Referring to FIG. 4, in a case that the Pentile data are Pentile data of four primary colors, a data transmission method according to an embodiment of the present disclosure includes step 401 to step 404.

In step 401, the RGB data is converted by the processor into Pentile data of four primary colors.

In the embodiment, the processor is capable of converting the RGB data into the Pentile data of four primary colors. The Pentile data of four primary colors converted from the RGB data includes Pentile data of RGBW, Pentile data of RGBY and the like. In practice, the arrangement of RGBW is achieved by adding a white color on the basis of tricolor, and the arrangement of RGBY is achieved by adding a yellow color on the basis of tricolor.

In step 402, four different colors of sub-pixels contained in the Pentile data of four primary colors are classified by the processor into two groups.

In step 403, a pixel is generated by the processor using two sub-pixels of different colors in each of the two groups.

In the embodiment, the processor is capable of classifying the four different colors of sub-pixels contained in the Pentile data of four primary colors into two groups. In practice, the processor may select randomly two different colors to be grouped together.

Figure 5:
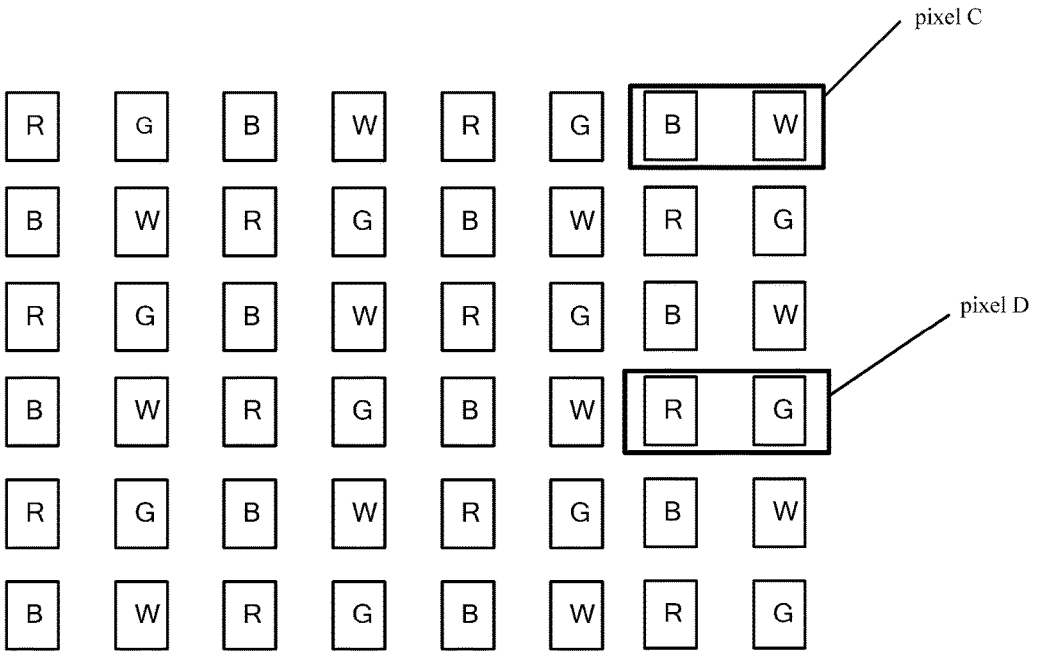
FIG. 5 is a schematic diagram of an arrangement of RGBW Pentile according to an embodiment of the present disclosure.

Reference is made to FIG. 5, which is a schematic diagram of an arrangement of RGBW Pentile. In FIG. 5, each rectangle block represents a sub-pixel, and text in the rectangle block indicates a color of the sub-pixel. RGBW Pentile includes four colors, namely, red color, blue color, green color and white color. Assuming that blue color is grouped with white color while green color is grouped with red color, a pixel (such as a pixel C shown in FIG. 5) is generated using a sub-pixel of blue color and a sub-pixel of white color, and a pixel (such as a pixel D shown in FIG. 5) is generated using a sub-pixel of green color and a sub-pixel of red color.

Since the Pentile data of four primary colors include multiple sub-pixels, multiple such pixels may be generated.

In step 404, each of the generated pixels is sent by the processor to the display drive system.

In the embodiment, the processor is capable of sending each of the generated pixels to the display drive system, and the display drive system sends a drive signal, which is generated by converting the Pentile data, to the display system.

The transmission rate for the processor to send the Pentile data of RGBW to the display drive system is described by taking a computer as an example hereinafter.

Assuming that the processor is to transmit an image of 2K4K RGB to the display system and the transmission rate is of 60 Hz, the transmission rate for the processor to transmit RGBW data to the display system is of only 8*106*2*8*60=7.6 Gbps. However, in the conventional technology, a processor has to transmit the RGB data to an additional chip. If the same image of 2K4K RGB is transmitted with the same transmission rate, the transmission rate is of 8*106*3*8*60=11.5 Gbps. And then the Pentile data are transmitted from the additional chip to the display drive system. It can be seen from the above that the power consumption for transmission is reduced with the innovation compared with the conventional technology.

In the embodiment, the processor converts the RGB data into the Pentile data of four primary colors, classifies four different colors of sub-pixels contained in the Pentile data of four primary colors into two groups, generates a pixel using two sub-pixels of different colors in each of the two groups, where multiple such pixels are generated from the Pentile data of four primary colors, and sends each of the generated pixels to the display drive system. In this way, only two sub-pixels are transmitted to the display drive system at a time by the original processor of the terminal device, thereby not only saving the costs of hardware but also reducing the power consumption for transmission.

Figure 6:
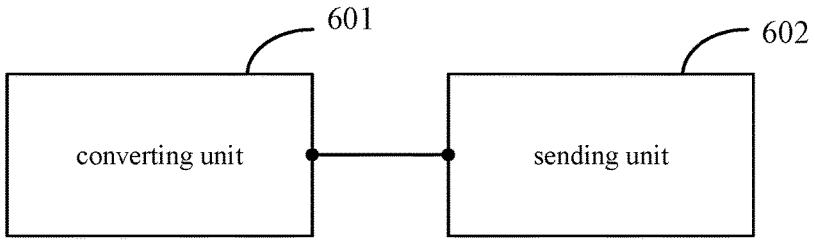
FIG. 6 is a schematic diagram of a processor according to an embodiment of the present disclosure.

A processor for performing the above data transmission method according to an embodiment of the present disclosure is described hereinafter. Reference is made to FIG. 6, which shows a basic logic structure of a processor according to an embodiment of the present disclosure. The processor includes a converting unit 601 and a sending unit 602.

The converting unit 601 is configured to convert RGB data into Pentile data.

The sending unit 602 is configured to send the Pentile data obtained after conversion to a display drive system, and the display drive system sends a drive signal, which is generated by converting the Pentile data, to a display system.

The processor, the display drive system and the display system are configured in a same terminal device.

In the embodiment, the processor converts the RGB data into the Pentile data via the converting unit 601 and then sends the Pentile data obtained after conversion to the display drive system via the sending unit 602, and the display drive system sends the drive signal, which is generated by converting the Pentile data, to the display system. Thus, no additional chip is needed, thereby saving the costs of hardware and reducing the power consumption for transmission.

Figure 7:
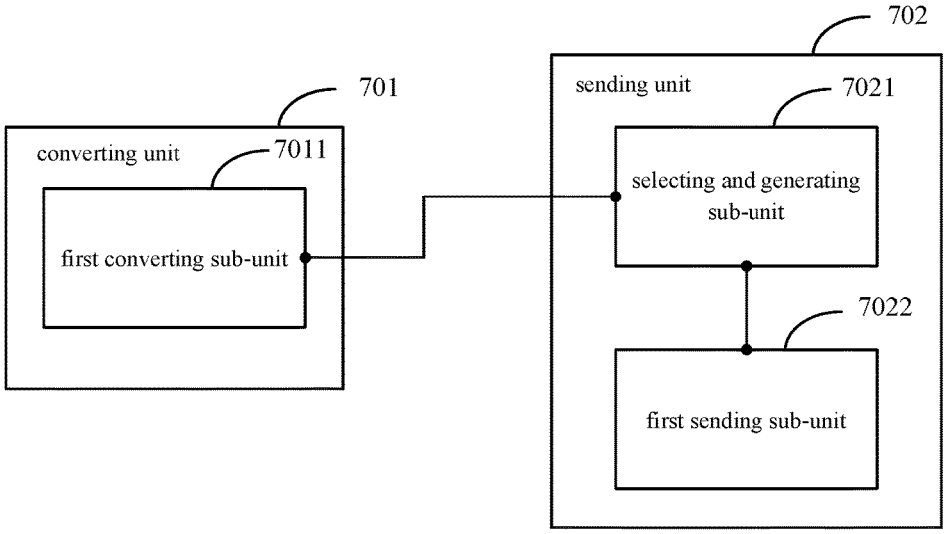
FIG. 7 is a schematic diagram of a processor according to an embodiment of the present disclosure.

For better understanding of the above embodiment, data exchange between various elements included in the processor is described with a specific example. In a case that the Pentile data are Pentile data of RGB, referring to FIG. 7, a processor according to an embodiment of the present disclosure includes: a converting unit 701 and a sending unit 702.

The converting unit 701 includes a first converting sub-unit 7011.

The sending unit 702 includes a selecting and generating sub-unit 7021 and a first sending sub-unit 7022.

The first converting unit 7011 is configured to convert the RGB data into Pentile data of RGB and then send the Pentile data obtained after conversion to the selecting and generating sub-unit 7021.

The selecting and generating sub-unit 7021 is configured to, in a case that the Pentile data obtained after conversion are the Pentile data of RGB, select one color from three different colors of sub-pixels contained in the Pentile data of RGB, generate a pixel by combining a sub-pixel of the selected one color serving as a common sub-pixel with a sub-pixel of each of two different unselected colors, where multiple such pixels are generated from the Pentile data of RGB, and then send each of the generated pixels to the first sending sub-unit 7022. In practice, the color for the common sub-pixel is selected randomly. For example, if red color is selected as a color for a common pixel, a pixel (such as a pixel A shown in FIG. 3) is generated by combining a sub-pixel of red color with a sub-pixel of green color, and a pixel (such as a pixel B shown in FIG. 3) is generated by combining the sub-pixel of red color with a sub-pixel of blue color. In this way, the Pentile data of RGB is converted to data of pixels each consisting of a sub-pixel of red color and a sub-pixel of green color and pixels each consisting of a sub-pixel of red color and a sub-pixel of blue color.

The first sending sub-unit 7022 may send each of the generated pixels to the display drive system, and the display drive system sends a drive signal, which is generated by converting the Pentile data, to a display system.

In the embodiment, the processor converts the RGB data into the Pentile data of RGB via the first converting sub-unit 7011. The selecting and generating sub-unit 7021, in a case that the Pentile data obtained after conversion are the Pentile data of RGB, selects one color from three different colors of sub-pixels contained in the Pentile data of RGB, and generates a pixel by combining a sub-pixel of the selected one color serving as a common sub-pixel with a sub-pixel of each of two different unselected colors, where multiple such pixels are generated from the Pentile data of RGB. The first sending sub-unit 7022 may send each of the generated pixels to the display drive system.

Figure 8:
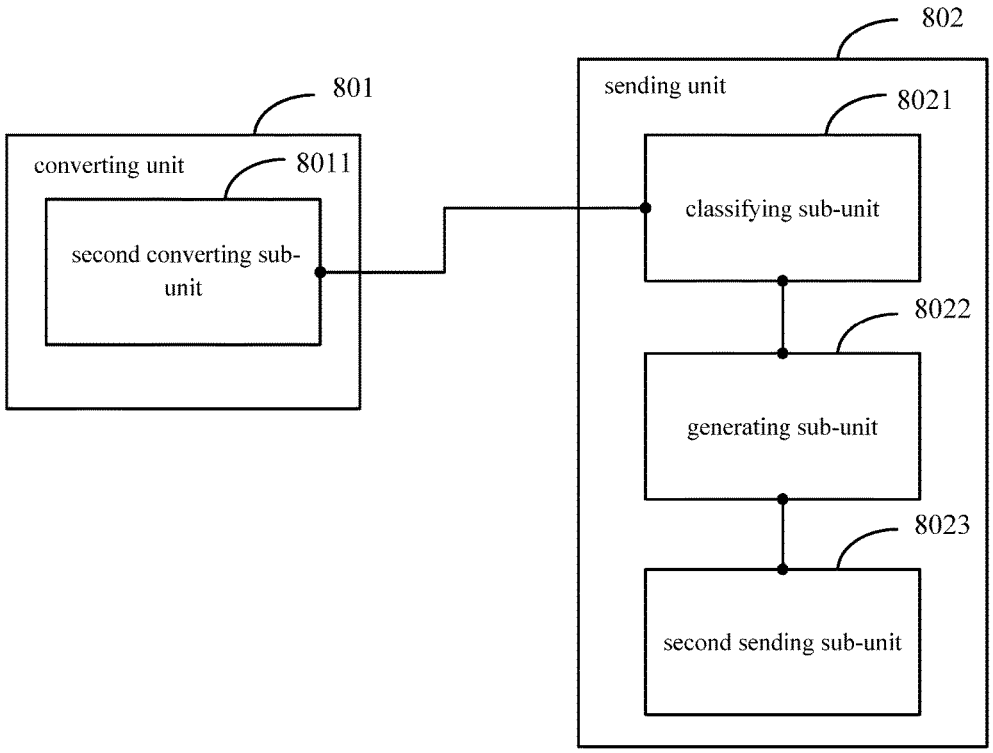
FIG. 8 is a schematic diagram of a processor according to an embodiment of the present disclosure.

For better understanding of the above embodiment, data exchange between various elements included in the processor is described with a specific example. In a case that the Pentile data are Pentile data of four primary colors, referring to FIG. 8, a processor according to an embodiment of the present disclosure includes: a converting unit 801 and a sending unit 802.

The converting unit 801 includes a second converting sub-unit 8011.

The sending unit 802 includes a classifying sub-unit 8021, a generating sub-unit 8022 and a second sending sub-unit 8023.

The second converting sub-unit 8011 is configured to convert the RGB data into Pentile data of four primary colors, and then send the Pentile data obtained after conversion to the classifying sub-unit 8021. The Pentile data of four primary colors converted from the RGB data include Pentile data of RGBW, Pentile data of RGBY, and the like. In practice, the arrangement of RGBW is achieved by adding a white color on the basis of tricolor, and the arrangement of RGBY is achieved by adding a yellow color on the basis of tricolor.

The classifying sub-unit 8021 is configured to, in a case that the Pentile data obtained after conversion are the Pentile data of four primary colors, classify four different colors of sub-pixels contained in the Pentile data of four primary colors into two groups, and then send the classification result to the generating sub-unit 8022. In practice, the processor may select randomly two different colors to be grouped together.

The generating sub-unit 8022 is configured to generate a pixel using two sub-pixels of different colors in each of the two groups. Since the Pentile data of four primary colors include multiple sub-pixels, multiple such pixels may be generated. Then the generating sub-unit 8022 sends the generated pixels to the second sending sub-unit 8023.

Reference is made to FIG. 5, which is a schematic diagram of an arrangement of RGBW Pentile. In FIG. 5, each rectangle block represents a sub-pixel, and text in the rectangle block indicates a color of the sub-pixel. RGBW Pentile includes four colors, namely, red color, blue color, green color and white color. Assuming that blue color is grouped with white color while green color is grouped with red color, a pixel (such as a pixel C shown in FIG. 5) is generated using a sub-pixel of blue color and a sub-pixel of white color, and a pixel (such as a pixel D shown in FIG. 5) is generated using a sub-pixel of green color and a sub-pixel of red color.

The second sending sub-unit 8023 sends each of the generated pixels to a display drive system, and the display drive system sends a drive signal, which is generated by converting the Pentile data, to a display system.

It should be noted that the processor, the display drive system and the display system are configured in a same terminal device.

In the embodiment, the processor converts the RGB data into the Pentile data of four primary colors via the converting sub-unit 8011, classifies four different colors of sub-pixels contained in the Pentile data of four primary colors into two groups via the classifying sub-unit 8021, generates a pixel using two sub-pixels of different colors in each of the two groups via the generating sub-unit 8022, where multiple such pixels are generated from the Pentile data of four primary colors, and then sends each of the generated pixels to the display drive system via the second sending sub-unit 8023. In this way, only two sub-pixels are transmitted to the display drive system at a time by the original processor of the terminal device, thereby not only saving the costs of hardware but also reducing the power consumption for transmission.

Figure 9:
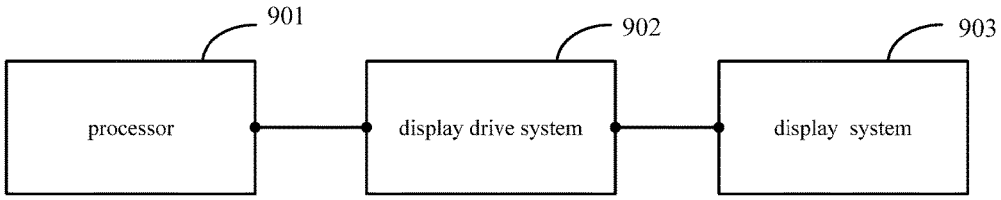
FIG. 9 is a schematic diagram of a terminal device according to an embodiment of the present disclosure.

A terminal device for performing the above data transmission method according to an embodiment of the present disclosure is described hereinafter. Reference is made to FIG. 9, which show a basic logic structure of a terminal device according to an embodiment of the present disclosure. The terminal device includes a processor 901, a display drive system 902 and a display system 903.

The processor 901 is configured to convert RGB data into Pentile data, and send the Pentile data obtained after conversion to the display drive system 902.

The display drive system 902 is configured to send a drive signal, which is generated by converting the Pentile data, to the display system 903.

The display system 903 is configured to display an image based on the received drive signal.

In the embodiment, the processor 901 converts the RGB data into the Pentile data, and sends the Pentile data obtained after conversion to the display drive system 902. The display drive system 902 sends the drive signal, which is generated by converting the Pentile data, to the display system 903. The display system 903 displays the image based on the received drive signal. In this way, no additional chip is needed, thereby saving the costs of hardware and reducing the power consumption for transmission.

For better understanding of the above embodiment, data exchange between various elements included in the terminal device is described with a specific example. Referring to FIG. 9 again, a terminal device according to an embodiment of the present disclosure includes a processor 901, a display drive system 902 and a display system 903.

The processor 901 is configured to convert the RGB data into Pentile data of RGB, select one color from three different colors of sub-pixels contained in the Pentile data of RGB, and generate a pixel by combining a sub-pixel of the selected one color serving as a common sub-pixel with a sub-pixel of each of two different unselected colors, where multiple such pixels are generated from the Pentile data of RGB, and then send each of the generated pixels to the display drive system 902.

The display drive system 902 is configured to send a drive signal, which is generated by converting the Pentile data, to the display system 903.

The display system 903 is configured to display an image based on the received drive signal.

In the embodiment, the terminal device converts the RGB data via the processor 901, and sends the Pentile data obtained after conversion to the display drive system 902. The display drive system 902 then sends a drive signal, which is generated by converting the Pentile data, to the display system 903. The display system 903 displays the image based on the received drive signal. In this way, only two sub-pixels are transmitted to the display drive system at a time by the original processor of the terminal device, thereby not only saving the costs of hardware but also reducing the power consumption for transmission.

For better understanding of the above embodiment, data exchange between various elements included in the terminal device is described with a specific example. Referring to FIG. 9 again, a terminal device according to an embodiment of the present disclosure includes a processor 901, a display drive system 902 and a display system 903.

The processor 901 is configured to convert the RGB data into Pentile data of four primary colors, classify four different colors of sub-pixels contained in the Pentile data of four primary colors into two groups, generate a pixel using two sub-pixels of different colors in each of the two groups, where multiple such pixels are generated from the Pentile data of four primary colors, and send each of the generated pixels to the display drive system 902.

The display drive system 902 is configured to send a drive signal, which is generated by converting the Pentile data, to the display system 903.

The display system 903 is configured to display an image based on the received drive signal.

In the embodiment, the terminal device converts the RGB data via the processor 901, and sends the Pentile data obtained after conversion to the display drive system 902. The display drive system 902 then sends a drive signal, which is generated by converting the Pentile data, to the display system 903. The display system 903 displays the image based on the received drive signal. In this way, only two sub-pixels are transmitted to the display drive system at a time by the original processor of the terminal device, thereby not only saving the costs of hardware but also reducing the power consumption for transmission.

It should be noted that, the processor in the embodiments of the present disclosure is the original central processing unit of the terminal device, and no additional chip or hardware is added into the terminal device.

It should be understood by those skilled in the art that, for a convenient and concise description, the operation procedure of the system, devices and units described above are not described herein and reference may be made to corresponding procedures of the method embodiments described previously.

The embodiments described above are only for illustrating the technical solutions of the present disclosure rather than for limiting the disclosure. Although the disclosure is described in detail with reference to the embodiments, it should be understood by those skilled in the art that amendments may be made to the technical solutions in the embodiments, or equivalent substitutions may be made to some technical features. The amendments or substitutions, however, do not cause the nature of corresponding technical solutions to depart from the spirit and scope of the technical solutions in the embodiments of the present disclosure.

The invention claimed is:

1. A data transmission method, comprising:

converting, by a processor, RGB data into Pentile data, wherein the Pentile data is Pentile data of RGB or Pentile data of four primary colors; and sending, by the processor, the Pentile data obtained after conversion to a display drive system, wherein the display drive system sends a drive signal, which is generated by converting the Pentile data, to a display system;

wherein the processor, the display drive system and the display system are configured in a same terminal device, wherein in a case that the Pentile data obtained after conversion are the Pentile data of four primary colors, the step of sending, by the processor, the Pentile data obtained after conversion to a display drive system comprises:

classifying, by the processor, four different colors of sub-pixels contained in the Pentile data of four primary colors into two groups;

generating, by the processor, a pixel using two sub-pixels of different colors in each of the two groups, wherein a plurality of the pixels are generated from the Pentile data of four primary colors; and sending, by the processor, each of the generated pixels to the display drive system, and wherein in a case that the Pentile data obtained after conversion are the Pentile data of RGB, the step of sending, by the processor, the Pentile data obtained after conversion to a display drive system comprises:

selecting, by the processor, one color from three different colors of sub-pixels contained in the Pentile data of RGB, and generating, by the processor, a pixel by combining a sub-pixel of the selected one color serving as a common sub-pixel with a sub-pixel of each of two different unselected colors, wherein a plurality of the pixels are generated from the Pentile data of RGB; and sending, by the processor, each of the generated pixels to the display drive system.

2. A processor, comprising:

a converting unit, configured to convert RGB data into Pentile data, wherein the converting unit comprises:

a first converting sub-unit, configured to convert the RGB data into Pentile data of RGB: or a second converting sub-unit, configured to convert the RGB data into Pentile data of four primary colors; and a sending unit, configured to send the Pentile data obtained after conversion to a display drive system, wherein the display drive system sends a drive signal, which is generated by converting the Pentile data, to a display system;

wherein the processor, the display drive system and the display system are configured in a same terminal device, wherein the sending unit comprises:

a selecting and generating sub-unit, configured to, in a case that the Pentile data obtained after conversion are the Pentile data of RGB, select one color from three different colors of sub-pixels contained in the Pentile data of RGB, and generate a pixel by combining a sub-pixel of the selected one color serving as a common sub-pixel with a sub-pixel of each of two different unselected colors, wherein a plurality of the pixels are generated from the Pentile data of RGB; and a first sending sub-unit, configured to send each of the generated pixels to the display drive system; or wherein the sending unit comprises:

a classifying sub-unit, configured to, in a case that the Pentile data obtained after conversion are the Pentile data of four primary colors, classify four different colors of sub-pixels contained in the Pentile data of four primary colors into two groups;

a generating sub-unit, configured to generate a pixel using two sub-pixels of different colors in each of the two groups, wherein a plurality of the pixels are generated from the Pentile data of four primary colors; and a second sending sub-unit, configured to send each of the generated pixels to the display drive system.

3. A terminal device, comprising: a processor, a display drive system and a display system; wherein the processor is configured to:

convert RGB data into Pentile data, wherein the Pentile data is Pentile data RGB or Pentile data of four primary colors; and send the Pentile data obtained after conversion to the display drive system;

the display drive system is configured to send a drive signal, which is generated by converting the Pentile data, to the display system; and the display system is configured to display an image based on the received drive signal, wherein the processor is further configured to:

in a case that the Pentile data obtained after conversion are the Pentile data of four primary colors, classify four different colors of sub-pixels contained in the Pentile data of four primary colors into two groups;

generate a pixel using two sub-pixels of different colors in each of the two groups, wherein a plurality of the pixels are generated from the Pentile data of four primary colors; and send each of the generated pixels to the display drive system, or in a case that the Pentile data obtained after conversion are the Pentile data of RGB, select one color from three different colors of sub-pixels contained in the Pentile data of RGB, and generate a pixel by combining a sub-pixel of the selected one color serving as a common sub-pixel with a sub-pixel of each of two different unselected colors, wherein a plurality of the pixels are generated from the Pentile data of RGB; and send each of the generated pixels to the display drive system.

* * * * *